US009346064B2

(12) United States Patent
Seitz et al.

(10) Patent No.: US 9,346,064 B2
(45) Date of Patent: May 24, 2016

(54) RADIUS EDGE BELL CUP AND METHOD FOR SHAPING AN ATOMIZED SPRAY PATTERN

(75) Inventors: David M. Seitz, Riga, MI (US); Kui-Chiu Kwok, Gurnee, IL (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 1348 days.

(21) Appl. No.: 11/228,671

(22) Filed: Sep. 16, 2005

(65) Prior Publication Data

US 2007/0063068 A1 Mar. 22, 2007

(51) Int. Cl.

| | |
|---|---|
| ***B05B 17/04*** | (2006.01) |
| ***B05B 3/10*** | (2006.01) |
| ***B05B 1/28*** | (2006.01) |
| ***B05B 5/00*** | (2006.01) |

(52) U.S. Cl.
CPC ..... *B05B 3/1092* (2013.01); *B05B 3/1064* (2013.01)

(58) Field of Classification Search
CPC ..... B05B 3/1092; B05B 3/1064
USPC ..... 239/291, 224, 7, 223, 700, 703, 704, 239/705, 290, 296, 297, 298
See application file for complete search history.

(56) References Cited

U.S. PATENT DOCUMENTS

| | | | | |
|---|---|---|---|---|
| 4,936,510 | A | 6/1990 | Weinstein | |
| 5,346,139 | A * | 9/1994 | Davis et al. | 239/703 |
| 5,474,236 | A * | 12/1995 | Davis et al. | 239/703 |
| 5,697,559 | A | 12/1997 | Davis et al. | |
| 5,820,036 | A * | 10/1998 | Saito | 239/703 |
| 5,862,988 | A * | 1/1999 | van der Steur | 239/288.5 |
| 5,909,849 | A * | 6/1999 | Yamasaki et al. | 239/700 |
| 6,050,499 | A * | 4/2000 | Takayama et al. | 239/112 |
| 6,135,365 | A * | 10/2000 | Kuwahara | 239/296 |
| 6,179,217 | B1 * | 1/2001 | Yoshida et al. | 239/7 |
| 6,189,804 | B1 * | 2/2001 | Vetter et al. | 239/7 |
| 6,230,994 | B1 * | 5/2001 | Boerner et al. | 239/700 |
| 6,341,734 | B1 * | 1/2002 | Van Der Steur | 239/223 |
| 6,360,962 | B2 * | 3/2002 | Vetter et al. | 239/106 |
| 6,513,729 | B2 * | 2/2003 | Ochiai et al. | 239/223 |
| 6,578,779 | B2 * | 6/2003 | Dion | 239/700 |
| 6,742,722 | B2 * | 6/2004 | Hosoda et al. | 239/305 |
| 6,811,094 | B2 * | 11/2004 | Kon et al. | 239/223 |
| 6,896,211 | B2 * | 5/2005 | Seitz | 239/700 |
| 6,899,279 | B2 * | 5/2005 | Seitz | 239/7 |
| 7,611,069 | B2 * | 11/2009 | Clifford et al. | 239/7 |
| 2004/0129799 | A1 * | 7/2004 | Krumma et al. | 239/290 |
| 2005/0045735 | A1 * | 3/2005 | Seitz | 239/7 |

FOREIGN PATENT DOCUMENTS

| | | | |
|---|---|---|---|
| JP | 09234395 | 9/1997 | B05B 5/04 |
| JP | 10296136 | 11/1998 | B05B 5/04 |

* cited by examiner

*Primary Examiner* — Len Tran
*Assistant Examiner* — Steven M Cernoch
(74) *Attorney, Agent, or Firm* — Fletcher Yoder P.C.

(57) ABSTRACT

A rotary atomizing applicator includes a shaping air system having first orifices discharging air against the outer surface of the bell cup, with the air following the bell cup and being released from the bell cup at the forward edge of the bell cup. A terminal portion of the outer surface of the bell cup directs the flow of air to shape the pattern of coating released from the bell cup. A second pattern of air is directed from outwardly and behind the bell cup inwardly toward the forward edge of the bell cup.

14 Claims, 5 Drawing Sheets

RADIUS EDGE BELL CUP AND METHOD FOR SHAPING AN ATOMIZED SPRAY PATTERN

FIELD OF THE INVENTION

The present invention relates generally to coating applicators and, more particularly, to rotary atomizing applicators and to the systems therein for shaping coating sprayed from such applicators.

BACKGROUND OF THE INVENTION

Both automated and hand operated spray applicators are used extensively in industry to apply coatings of various types to objects during manufacture and assembly. Automobile vehicle bodies commonly are coated using robotic devices with spray applicators. The evolution of applicators has followed both the need and desire to improve spraying efficiency and minimize waste of the coating material that is applied.

It is known to use atomizing applicators to reduce the amount of overspray and ensure that the object is uniformly covered. In one known type of atomizing applicator, a bell cup having a narrow base and a wider forward edge is rotated at high speed. The coating material, such as paint, is provided to the inside of the rotating cup. The paint or other coating moves outwardly along the substantially smooth inner surface of the bell cup and is discharged from the forward edge of the bell cup as a result of centrifugal force from the rotating cup. The coating is atomized into a fine mist as it leaves the bell cup surface. The velocity of the mist is determined by many factors, including the shape of the bell cup, but generally is at an angle both forwardly and outwardly from the bell cup. To move the coating more forwardly and less outwardly from the discharge path off the surface of the bell cup, it is known to use shaping air streams to confine and direct the atomized coating toward the target object. It is also known to charge the atomized mist with electrical potential and to ground the object being coated so that the coating material is attracted to the object, further reducing overspray and improving coverage on irregularly shaped target objects.

While rotary atomizing applicators as described above have been used successfully in many industries, it is desirable to further reduce the waste of sprayed material. The natural direction of the atomized particles discharged from the forward edge of the rotary bell cup has a significant radially outward component. Shaping air streams have been used to attempt to confine the outward divergence of the spray pattern by flowing an air stream along the spray pattern outwardly from the bell cup. Known shaping air systems have used high pressure air at the forward edge of the bell cup, high air volumes and/or air directed at the lower base of the bell cup to follow along the bell cup. However, these systems have not been completely effective in controlling the outward velocity of the coating material. High velocity coating particles, such as metal flakes in paint, can pass through the high pressure air streams at the bell cup edge used in some shaping air systems. Shaping air systems using large air volumes are limited in pattern size. Shaping air systems in which air follows the outer surface of the bell cup release the shaping air streams at outward trajectories following essentially the same angle as the exterior of the cup, and not directly at the target object. Accordingly, in some situations it has been difficult to confine all of the spray to a narrow pattern when small target objects are being coated. Coating inconsistencies have occurred when particles in the coating, such as metal flake in paint are confined by the shaping air less consistently than the coating mist in which the particles are contained. The result is a separation of the metal flakes from the paint, and inconsistent coverage of metal flakes on the coated object.

What are needed in the art are a spray applicator head configuration and a method for controlling spray patterns which smoothly and evenly confine the spray to a narrow pattern ahead of the applicator.

SUMMARY OF THE INVENTION

The present invention provides a spray applicator having a curved segment at the forward edge of the bell cup and shaping air flow near the base of the bell cup such that the shaping air attaches to and follows along the outer surface of the bell cup including a smooth transition to substantially parallel flow relative to the axis of the bell cup.

In one aspect thereof, the present invention provides a method for shaping the pattern of coating sprayed from a rotary atomizing sprayer device in which coating is supplied to an interior surface of a rotary cup and caused to flow along the cup and to be discharged off a forward edge of the cup from centrifugal force acting on the coating as a result of spinning the cup about an axis of the cup. The method for shaping the pattern includes steps of providing the bell cup with a base and an outer surface extending outwardly and forwardly from the base, and a terminal portion at the forward edge of the bell cup transitioning from the outwardly and forwardly directed outer surface of the bell cup to a substantially forwardly directed segment adjacent the forward edge; providing a plurality of air passage orifices near the base of the outer surface of the bell cup; emitting air from the air passage orifices in a first pattern of first air streams against and following the bell cup outer surface; and redirecting the air streams at the terminal portion from generally outwardly directed flow relative to the bell cup axis to generally forwardly directed flow substantially parallel to the axis and adjacent to the coating discharged off the forward edge of the bell cup In another aspect thereof, the present invention provides a rotary atomizing sprayer with a bell cup having a forward edge, the bell cup being rotatably about an axis of the cup. The bell cup has a substantially smooth inner surface along which coating flows to the forward edge, and an outer surface of the bell cup extending toward the forward edge. A terminal portion of the outer surface converges with the inner surface at the forward edge. A first plurality of first air orifices are directed toward the outer surface at or rearward of the terminal portion.

In still a further aspect thereof, the present invention provides a method for shaping the pattern of coating sprayed from a rotary atomizing sprayer device in which coating is supplied to an inner surface of a rotating cup and caused to flow along the cup and to be discharged off a forward edge of the cup from centrifugal force acting on the coating as a result of spinning the cup about an axis of the cup. The method for shaping the pattern includes steps of providing an outer surface on the cup having a terminal portion adjacent the forward edge defining a desired angular relationship with the inner surface; providing a first plurality of first air orifices; discharging a first pattern of first air streams from the first plurality of first air orifices toward the outer surface of the bell cup at an angle whereby the first air streams follow along the outer surface of the bell cup toward the forward edge thereof; controlling the direction of the first air streams along the terminal portion; and releasing the first plurality of first air streams from the outer surface of the bell cup at the forward edge in a desired direction relative to coating discharged from the inner surface.

An advantage of the present invention is providing a rotary atomizing applicator in which a spray coating discharged from the applicator is confined to a narrow pattern in front of the applicator.

Another advantage of the present invention is limiting the volume of coating material not moved directly at the target being coated, and improving the transfer efficiency of coating to the object.

Still another advantage of the present invention is providing a shaping air system that acts directly on the coating material as it leaves a rotary cup atomizer, and uses less air than known systems.

Yet another advantage of the present invention is improving color match properties of coatings containing metallic flake, and minimizing the separation and loss of flakes.

Other features and advantages of the invention will become apparent to those skilled in the art upon review of the following detailed description, claims and drawings in which like numerals are used to designate like features.

Figure 1:
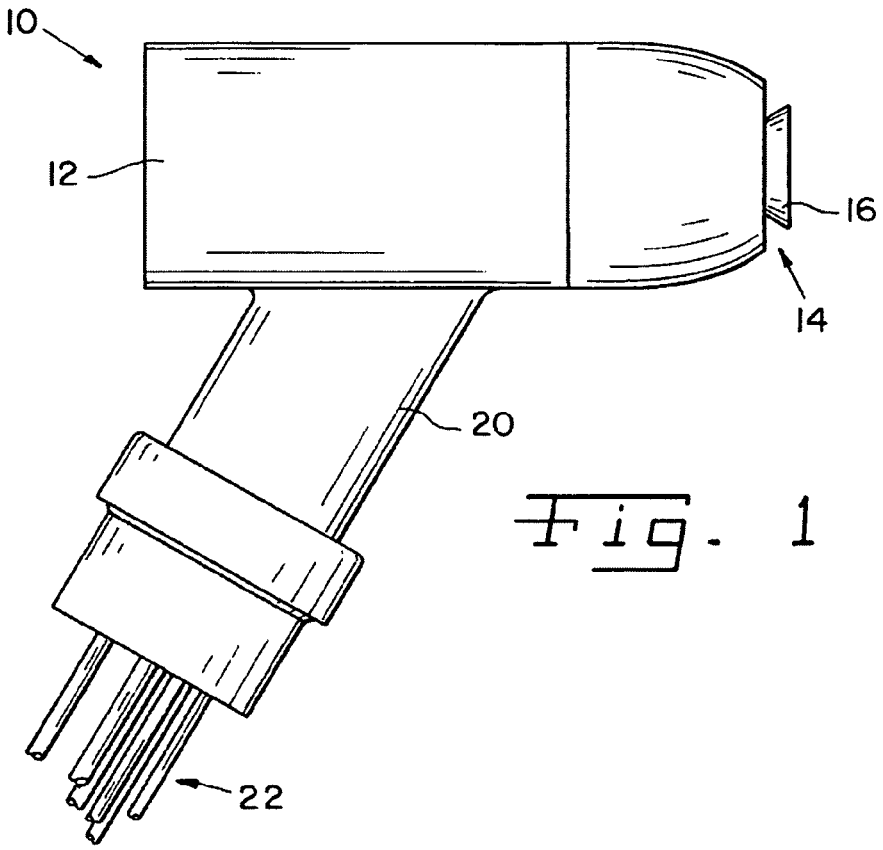
FIG. 1 is a side view of one type of a rotary atomizing applicator in accordance with the present invention.
Figure 2:
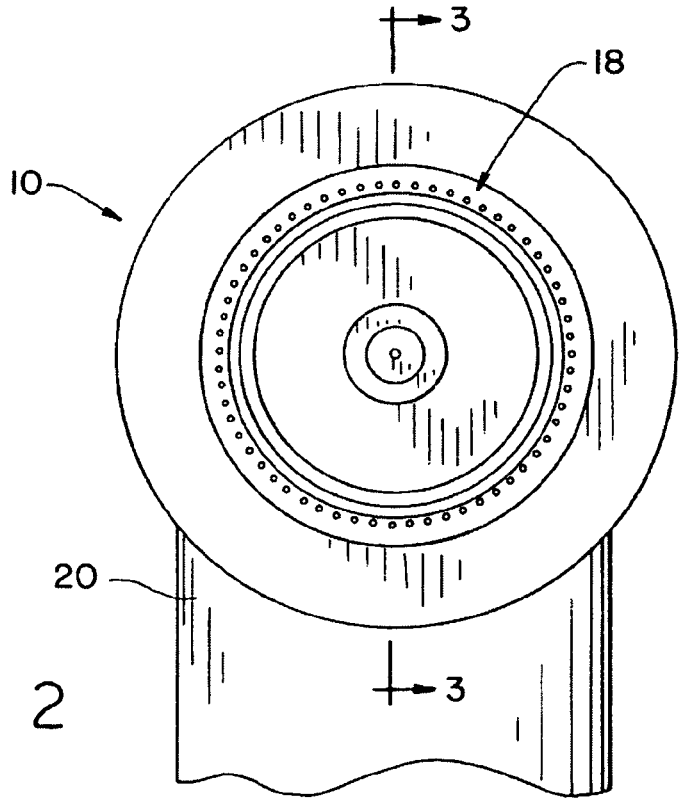
FIG. 2 is a fragmentary front view of the rotary atomizing applicator shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates a rotary atomizing coating applicator in accordance with the present invention. Those skilled in the art will understand readily that the exemplary applicator 10 shown can be mounted on and operated by a robot (not shown) for performing controlled series of maneuvers to properly and consistently coat a series of objects in a manufacturing process. For example, such applicators are used to paint automobile vehicle bodies. However, applicators of this type also can be used for coating a variety of different objects with paint and other coatings. It should be further understood that the present invention works well with different styles and types of applicators and applicator 10 shown is merely one example of such a device. For example, the present invention can be used on applicators that are hand operated, or operated other than by a robot.

Applicator 10 includes a main body portion 12 having an atomizing head 14 on the forward end thereof. Head 14 includes a rotary bell cup 16 and a shaping air system 18 that cooperate one with the other in the application of coating, as will be explained more fully hereinafter. Additionally, applicator 10 includes a connector arm 20 by which various electrical, air and/or other systems and supplies are connected to or from a robot (not shown) for operation of applicator 10. The various systems connected to applicator 10 are indicated by the conductors and conduits generally indicated at numeral 22.

Figure 3:
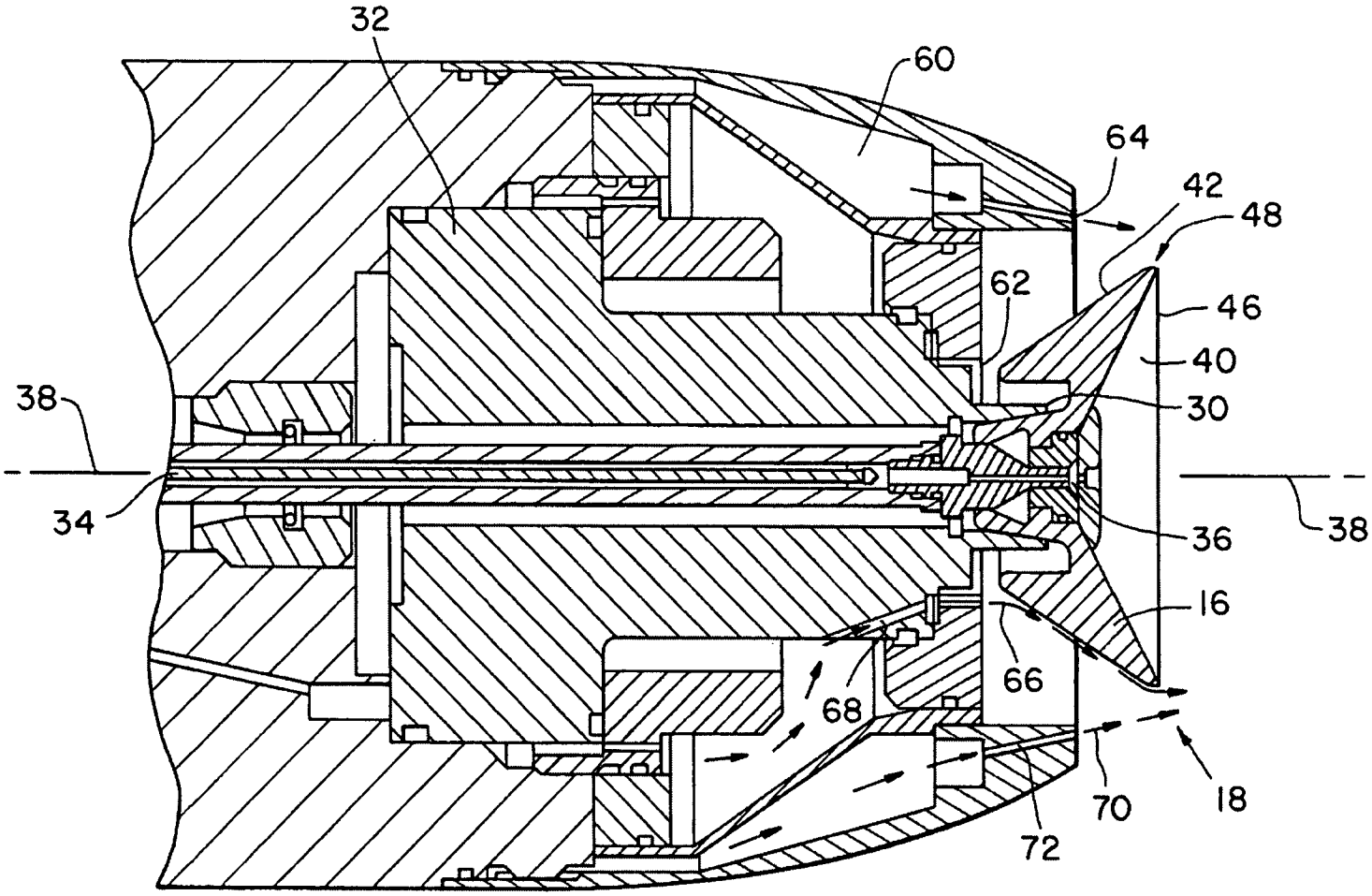
FIG. 3 is an enlarged, fragmentary cross-sectional view of the head of the rotary applicator shown in FIGS. 1 and 2, the cross-section being taken along line 3-3 of FIG. 2.

Referring now more specifically to FIG. 3, rotary bell cup 16 is disposed on an end 30 of an air turbine 32. Turbine 32 is operated by pressurized air to rotate at high speed, thus rotating bell cup 16 at high speed via end 30. A coating supply tube 34 extends through turbine 32 and has an outlet 36 in bell cup 12 whereby coating material, such as paint, from a supply (not shown) is supplied to and discharged in bell cup 16. Tube 34 extends substantially along an axis of applicator 10, indicated by line segments 38 in FIG. 3. A distributing body, splash plate, or other suitable structures and arrangements can be provided in bell cup 16, confronting or associated with supply tube outlet 36 or otherwise disposed to receive the coating material from supply tube 34 and to distribute the coating material evenly in cup 16. The general construction and operation of applicator 10 thus far described, including the construction and operation of turbine 32, supply tube 34 and the deposit and handling of coating in bell cup 16 are known to those skilled in the art and will not be described in further detail herein.

Figure 4:
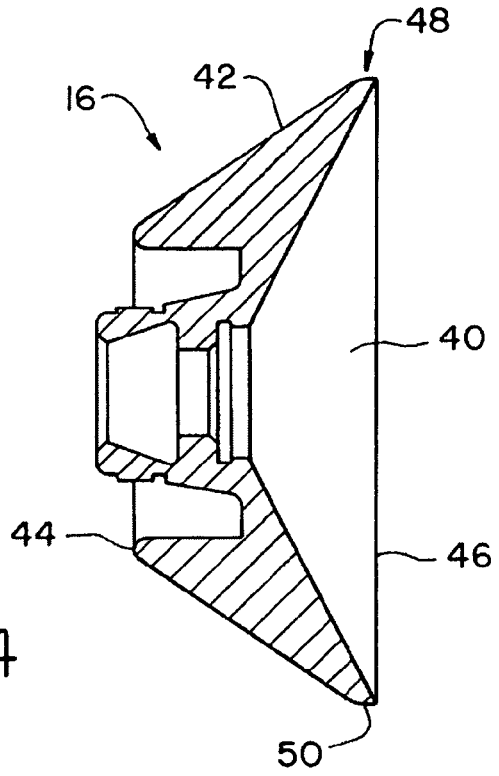
FIG. 4 is a further enlarged cross-sectional view of the bell cup in the atomizing applicator shown in FIG. 3.

Bell cup 16 in the exemplary embodiment of present invention shown in FIGS. 1-4 is a cup or bowl-like body rotatable about its axis which also is on the axis indicated by line segments 38. Bell cup 16 has an inner surface 40 and an outer surface 42. The cup-like shape of bell cup 12 provides a relatively narrow base 44 and a broader forward edge 46. Inner surface 40 is substantially smooth, and expands outwardly from base 44 to forward edge 46. Outer surface 42 is also smooth, and expands outwardly from base 44 for a substantial length of outer surface 42. A terminal portion 48 of outer surface 42 adjacent forward edge 46 defines a transition area between inner surface 40 and outer surface 42. As best seen in the enlargement of FIG. 4, from outer surface 42, terminal portion 48 is smoothly curved or radiused, and establishes a transition from the generally and significantly outwardly directed orientation of outer surface 42 to a forwardly directed segment 50 adjacent to forward edge 46. Segment 50 is substantially parallel to axis 38.

Shaping air system 18, best seen in FIG. 3, includes a manifold area 60 which receives a flow of pressurized air and from which a first plurality of first orifices 62 and second plurality of second orifices 64 are supplied with pressurized air. First orifices 62 are positioned behind bell cup 16, near base 44 and are oriented in a manner such that a first pattern of first air streams 66 is directed toward bell cup 16, from behind base 44, and substantially parallel to axis 38. First orifices 62 are connected to manifold area 60 by air passages 68, allowing pressurized air supplied to manifold area 60 to flow to and be emitted from first orifices 62. In a preferred embodiment, first orifices 62 are provided at evenly spaced locations, in a substantially circular pattern, behind and slightly outwardly of base 44. Air streams 66 from first orifices 62 approach outer surface 42, and attach to surface 42 to follow along surface 42 toward terminal portion 48 and forward edge 46. As streams 66 advance, each stream follows the surface to which it attaches, and is therefore redirected at terminal portion 48 to leave the surface of bell cup 16 from segment 50, in substantially forwardly directed streams substantially parallel to axis 38.

Second orifices 64 are disposed slightly behind and outwardly of terminal portion 48 and forward edge 46. Second orifices 64 are oriented in a manner such that a second pattern of second air streams 70 is directed inwardly and forwardly toward the area at which first air streams 66 are redirected by terminal portion 48 and separate from forward edge 46. Second orifices 64 are connected in flow communication to manifold area 60 via passages 72, allowing pressurized air from manifold area 60 to flow to and be emitted from second orifices 64.

During use of the present invention, bell cup 16 is spun at high velocity through the operation of turbine 32, in known manner. Coating material, such as paint, is supplied via tube 34 to the inside of bell cup 16 and is deposited on inner surface 40. Centrifugal force acting on the coating material causes the material to move along inner surface 40 toward forward edge 46. As the coating material advances off forward edge 46, the acceleration of the coating material is forward and outward relative to bell cup 16 and axis 38, respectively.

Shaping air system 18 is used to confine the spray pattern of material being ejected from forward edge 46 and thereby to improve the transfer efficiency of the coating being applied to an object being coated. Pressurized air is provided to manifold area 60 and from manifold area 60 to first orifices 62 and second orifices 64 via passages 68 and 72, respectively. Air streams 66 from first orifices 62 approach and attach to outer surface 42, following along outer surface 42 toward forward edge 46. The smoothly curved or rounded transition provided by terminal portion 48 allows airstreams 66 to follow there along to forward edge 46. As first airstreams 66 approach and move along terminal portion 48, the air streams are re-directed, ultimately following segment 50. Accordingly the generally outwardly directed path is altered to a more forward path, and first air streams 66 depart bell cup 16 in substantially forward paths adjacent to the coating material leaving forward edge 46, and substantially parallel to axis 38. Air streams 66 thereby operate against the coating material immediately as the coating material leaves forward edge 46. The spray pattern is confined and controlled immediately. Air streams 66 establish a barrier, or resistance to further outward expansion of the spray pattern ahead of bell cup 16. Even high velocity particles in the coating, such as metal flakes, are controlled more consistently by the present invention. Acting directly on the coating as the coating leaves bell cup 16 allows shaping air system 18 to use less air than other known systems. As an additional benefit from the present invention, forward edge 46 remains clean and coating build-up is reduced with air streams 66 passing closely thereto and the resultant immediate redirection of the coating material in a more forward path.

Second air streams 70 are directed inwardly and forwardly from second orifices 64, substantially at the area of forward edge 46. Second air streams 70 emitted from second orifices 64 thereby reinforce the resistance to the outward expansion of the spray pattern of coating material leaving forward edge 46, confining the spray pattern to a smaller, more concentrated pattern.

Advantages of the present invention can be achieved with bell cup configurations and shaping air system locations relative thereto different from that shown in the preferred arrangement shown in FIGS. 1-4. Several alternate embodiments of the present invention are shown in FIGS. 5-7.

Figure 5:
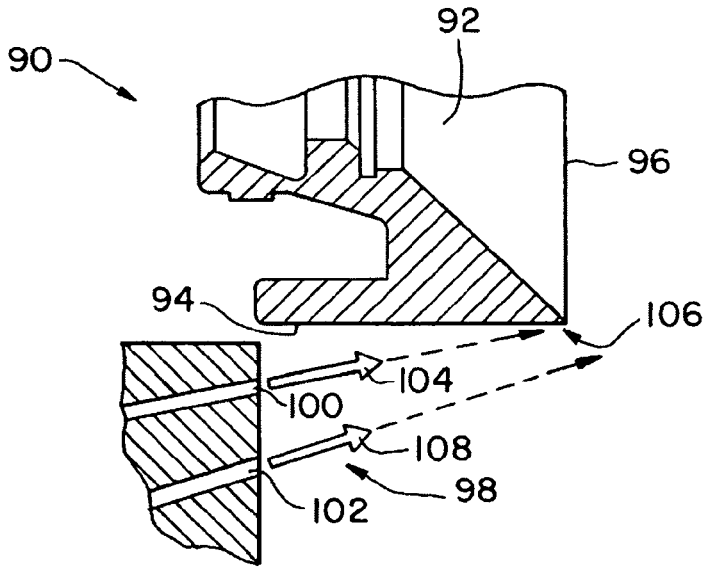
FIG. 5 is an enlarged, fragmentary cross-sectional view of another embodiment of the present invention.

FIG. 5 illustrates a bell cup 90 having an outwardly expanding inner surface 92 and a substantially cylindrical outer surface 94 defined about and substantially parallel to the axis of bell cup 90. Inner surface 92 and outer surface 94 converge at a forward edge 96, from which paint or other coating is released from inner surface 92 during use of bell cup 90. A shaping air system 98 includes a first plurality of first orifices 100 and a second plurality of second orifices 102, each supplied with pressurized air from an air supply source as described previously herein. It should be understood that orifices 100 and 102 are arranged in a circular pattern around bell cup 90, similar to orifices 62 and 64. While only one orifice 100 and one orifice 102 are shown in FIG. 5, it should be understood further that shaping air system 98 includes a plurality of closely spaced orifices 100 and a plurality of closely spaced orifices 102. First orifices 100 and second orifices 102 are positioned outwardly of bell cup 90. First orifices 100 direct first air streams 104 against outer surface 94 at a terminal portion 106 of outer surface 94 adjacent to and rearward of forward edge 96 a sufficient distance such that air streams 104 attach to and follow terminal portion 106 to forward edge 96. Second orifices 102 direct second air streams 108 at or forward of forward edge 96 to further confine the pattern of paint or other coating dispensed from bell cup 90.

Figure 6:
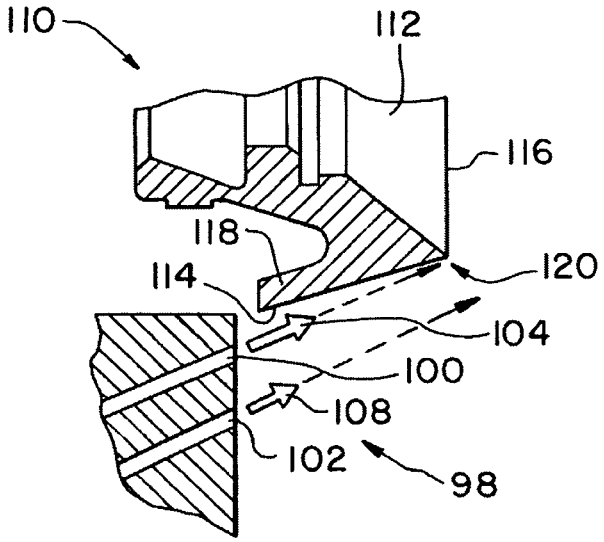
FIG. 6 is an enlarged, fragmentary cross-sectional view of yet another embodiment of the present invention.

FIG. 6 illustrates a bell cup 110 having an outwardly expanding inner surface 112 and an outer surface 114 that angles inwardly toward a forward edge 116 from a rearward portion 118. Shaping air system 98, as described previously with respect to FIG. 5, includes a first plurality of first orifices 100 and a second plurality of second orifices 102, each supplied with pressurized air from an air supply source as described previously herein. First orifices 100 and second orifices 102 are positioned outwardly of bell cup 110. First orifices 100 direct first air streams 104 against outer surface 114 at a terminal portion 120 of outer surface 114 adjacent to and rearward of forward edge 116 a sufficient distance such that air streams 104 attach to and follow terminal portion 120 to forward edge 116. Second orifices 102 direct second air streams 106 at or forward of forward edge 116 to further confine the pattern of paint or other coating dispensed from bell cup 110.

Figure 7:
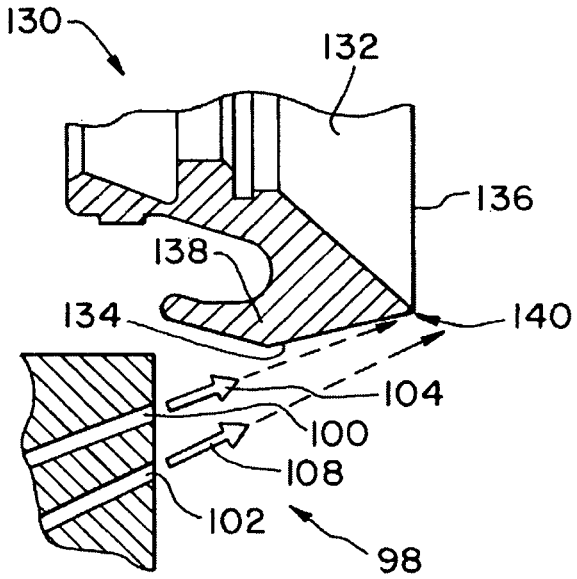
FIG. 7 is an enlarged, fragmentary cross-sectional view of still another embodiment of the present invention.

FIG. 7 illustrates a bell cup 130 having an outwardly expanding inner surface 132 and an outer surface 134 that angles inwardly toward a forward edge 136 from a rearward portion 138. While bell cup 130 is shaped similarly to bell cup 110, outer surfaces 134 and 114 of bell cups 130 and 110 are provided at different angles relative to inner surfaces 132 and 112, respectively. Shaping air system 98, as described previously with respect to FIGS. 5 and 6, includes a first plurality of first orifices 100 and a second plurality of second orifices 102, each supplied with pressurized air from an air supply source as described previously herein. First orifices 100 and second orifices 102 are positioned outwardly of bell cup 130. First orifices 100 direct first air streams 104 against outer surface 134 at a terminal portion 140 of outer surface 134 adjacent to and rearward of forward edge 136 a sufficient distance such that air streams 104 attach to and follow terminal portion 140 to forward edge 136. Second orifices 102 direct second air streams 106 at or forward of forward edge 136 to further confine the pattern of paint or other coating dispensed from bell cup 130.

During use of the embodiments shown in FIGS. 5-7, terminal portions 106, 120 and 140 control the direction at which shaping air is released from outer surfaces 94, 114 and 134, respectively. By providing the desired angular orientation relative to inner surfaces 92, 112 and 132 the pattern and direction of shaping air is controlled by the shaping air following terminal portions 106, 120 and 140, as the shaping air is released from outer surfaces 94, 114 and 134, respectively.

Figure 8:
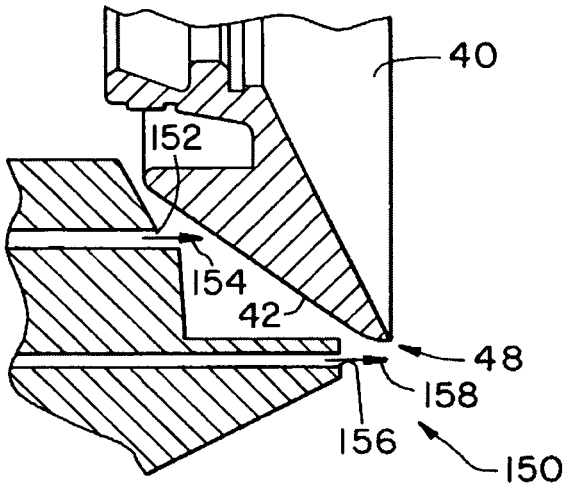
FIG. 8 is an enlarged, fragmentary cross-sectional view of a further embodiment of the present invention.
Figure 9:
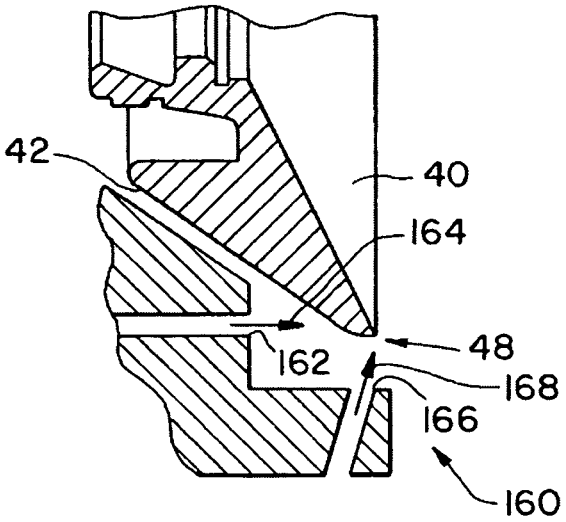
FIG. 9 is an enlarged, fragmentary cross-sectional view of a still further embodiment of the present invention.

FIG. 8 and FIG. 9 show still further embodiments of the present invention that include bell cup 16 as shown in FIG. 4. A shaping air system 150 in FIG. 8 includes a plurality of first orifices 152 supplying first air streams 154 substantially parallel to an axis of bell cup 16, and to a plurality of second orifices 156 supplying second air streams 158. FIG. 9 includes a shaping air system 160 having first orifices 162 supplying first air streams 164 and second orifices 166 supplying second air streams 168. As can be seen from the embodiments of FIGS. 8 and 9, first air streams 154, 164 can be supplied anywhere along outer surface 42 to attach thereto and be redirected by terminal portion 48. Second air streams 158, 168 can be supplied at various angles relative to terminal portion 48 to reinforce the confinement of spray released from inner surface 40.

In accordance with the present invention, the outer surface of the bell cup is used to shape and direct the pattern of at least a portion of the shaping air. A plurality of first air streams from a plurality of first orifices contact and follow the outer surface of the bell cup for at least a portion of the outer surface rearward of the bell cup forward edge, from which coating is released from the bell cup. The angle, orientation and shape of the outer surface of the bell cup, and the positions of the shaping air orifices with respect to the outer surface of the bell cup, can be varied to provide the pattern and direction of shaping air desired at the bell cup forward edge. As shown in the exemplary embodiments, the outer surface of the bell cup can be outwardly angled or inwardly angled toward the forward edge of the bell cup from rearward portions of the bell cup. The outer surface also can be substantially cylindrical and axially oriented. Air emitting air orifices of the shaping air system can be positioned behind the bell cup, inward of the forward edge, or outward of the bell cup. Configurations for the bell cup and shaping air system other than those shown and described herein also can be used.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A method for shaping the pattern of coating sprayed from a rotary atomizing sprayer device in which coating is supplied to an interior surface of a rotary cup and caused to flow along the cup and to be discharged off a forward edge of the cup from centrifugal force acting on the coating as a result of spinning the cup about an axis of the cup, said method for shaping the pattern comprising:

providing the bell cup with a base and an outer surface extending outwardly and forwardly from the base, and a terminal portion at the forward edge of the bell cup transitioning from the outwardly and forwardly directed outer surface of the bell cup to a more forwardly and less outwardly directed segment adjacent the forward edge and parallel to the axis of the bell cup, the more forwardly less outwardly directed segment being of sufficient axial length for redirecting airflow of an air stream attached to and flowing along the outer surface of the bell cup to a forwardly directed airflow at the forward edge of the bell cup;

providing a plurality of air passage orifices near the base of the outer surface of the bell cup;

pressurizing air to a pressure above ambient air pressure and emitting the pressurized air from the air passage orifices in a first pattern of first shaping air streams against attached to and following the bell cup outer surface, from near the base to and including along the terminal portion;

redirecting the attached first shaping air streams with the shape of the bell cup outer surface at the terminal portion from generally outwardly directed flow relative to the bell cup axis to generally forwardly directed flow parallel to the axis at the forward edge of the bell cup; and discharging the first shaping air streams from attachment to the outer surface of the bell cup at the forward edge of the bell cup in a generally forwardly directed flow parallel to the bell cup axis adjacent to the coating discharged off the forward edge of the bell cup.

2. The method of claim 1, including providing the air passage orifices in evenly spaced locations around the base of the cup.

3. The method of claim 1, including providing a second pattern of second shaping air streams at a pressure greater than ambient pressure, and directing said second pattern of second shaping air streams inwardly toward the forward edge of the bell cup without attachment to the bell cup outer surface.

4. The method of claim 3, including directing the second pattern of second shaping air streams both inwardly and forwardly from outwardly of and behind the forward edge of the bell cup.

5. The method of claim 4, including emitting the first pattern of first shaping air streams parallel to the axis of the bell cup.

6. The method of claim 1, including emitting the first pattern of first shaping air streams parallel to the axis of the bell cup from outwardly of the base of the bell cup.

7. A rotary atomizing sprayer comprising:

a bell cup having a forward edge, said bell cup being rotatable about an axis of said cup;

a smooth inner surface of said bell cup along which coating flows to said forward edge;

a smoothly curved outer surface of said bell cup extending toward said forward edge;

a terminal portion of said smoothly curved outer surface converging with said inner surface at said forward edge, said terminal portion being smoothly curved from a significantly outwardly directed orientation to a forwardly directed segment parallel to said axis of said cup, said outer surface, including said terminal portion thereof, being of sufficient curvature and of sufficient length for redirecting air flow of an air stream attached to and flowing along the outer surface to forwardly directed air flow away from said bell cup parallel to the bell cup axis; and a shaping air system including a first plurality of first shaping air orifices directed toward said outer surface at least one of at and rearward of said terminal portion, and a source of pressurized air supplying air pressurized above ambient pressure to said first plurality of first shaping air orifices.

8. The rotary atomizing sprayer of claim 7, including a second plurality of second shaping air orifices connected to said source of pressurized air and directed at said forward edge.

9. The rotary atomizing sprayer of claim 8, said second plurality of second shaping air orifices being positioned wider than and rearward of said forward edge, and said second plurality of second shaping air orifices directed inwardly and forwardly toward said forward edge.

10. The rotary atomizing sprayer of claim 7, said first plurality of first shaping orifices being positioned behind said bell cup radially inwardly of said forward edge and directed parallel to said axis of said bell cup.

11. The rotary atomizing sprayer of claim 7, said bell cup having a base, said forward edge being wider than said base, and said outer surface extending outwardly from said base to said forward edge.

12. The rotary atomizing sprayer of claim 11, said terminal portion defining a smooth transition from outwardly expanding to forwardly directed, and said forwardly directed segment being adjacent said forward edge.

13. The rotary atomizing sprayer of claim 7, said cup having a rearward portion, and said outer surface extending inwardly from said rearward portion to said forward edge.

14. The rotary atomizing sprayer of claim 7, said outer surface being substantially cylindrical.

* * * * *